US011531289B2

(12) United States Patent
Kobayashi

(10) Patent No.: US 11,531,289 B2
(45) Date of Patent: Dec. 20, 2022

(54) IMAGE FORMING APPARATUS, REPLACEMENT DEVELOPING COMPONENT, AND METHOD FOR CONTROLLING IMAGE FORMING APPARATUS

(71) Applicant: KYOCERA Document Solutions Inc., Osaka (JP)

(72) Inventor: Yuya Kobayashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/501,939

(22) Filed: Oct. 14, 2021

(65) Prior Publication Data

US 2022/0128926 A1 Apr. 28, 2022

(30) Foreign Application Priority Data

Oct. 22, 2020 (JP) ..... JP2020-177130

(51) Int. Cl.

| | |
|---|---|
| ***G03G 15/10*** | (2006.01) |
| ***G03G 15/08*** | (2006.01) |
| ***G03G 21/18*** | (2006.01) |
| ***G03G 15/00*** | (2006.01) |

(52) U.S. Cl.

CPC ..... *G03G 15/086* (2013.01); *G03G 15/0877* (2013.01); *G03G 15/556* (2013.01); *G03G 21/1814* (2013.01)

(58) Field of Classification Search

CPC ..... G03G 15/0856; G03G 15/0858; G03G 15/086; G03G 15/0877; G03G 15/556; G03G 21/1814

See application file for complete search history.

(56) References Cited

U.S. PATENT DOCUMENTS 8,265,493 B2 * 9/2012 Amann ..... G03G 15/0856 399/61

FOREIGN PATENT DOCUMENTS

JP 2000-29372 A 1/2000

* cited by examiner

*Primary Examiner* — Hoang X Ngo
(74) *Attorney, Agent, or Firm* — Stein IP, LLC

(57) ABSTRACT

An image forming apparatus includes an accommodating portion, a motor, and a development sensor. In the accommodating portion, a replacement developing component is fitted. The replacement developing component is fitted with a rotary member including an operating member, and stores toner. The motor rotates the rotary member on the replacement developing component fitted in the accommodating portion. When a new replacement developing component is fitted, the development sensor is not in contact with the operating member before the motor rotates the rotary member and is in contact with the operating member on the rotary member that has moved as the motor rotates. The development sensor outputs a first level when in contact with the operating member and outputs a second level when not in contact with the operating member.

14 Claims, 11 Drawing Sheets

FIG.9

| OUTPUT LEVEL | | JUDGMENT RESULT |
|---|---|---|
| 1ST TIME POINT (BEFORE ROTATION) | 2ND TIME POINT (AFTER ROTATION) | |
| 2ND LEVEL (OFF) | 1ST LEVEL (ON) | - REPLACEMENT DEVELOPING COMPONENT FITTED<br>- BRAND-NEW |
| 1ST LEVEL (ON) | 1ST LEVEL (ON) | - REPLACEMENT DEVELOPING COMPONENT FITTED<br>- NOT BRAND-NEW |
| 2ND LEVEL (OFF) | 2ND LEVEL (OFF) | - REPLACEMENT DEVELOPING COMPONENT NOT FITTED |
| 1ST LEVEL (ON) | 2ND LEVEL (OFF) | - IRREGULAR CONDITION |

FIG.11

D1

| FULL-LOAD VALUE DATA | | |
|---|---|---|
| | | INITIAL REMAINING QUANTITY VALUE (g) |
| FACTORY-SUPPLIED COMPONENT | | AAAA |
| GENERALLY DISTRIBUTED COMPONENT | FOR CHINA | BBBB |
| | FOR ASIA | CCCC |
| | FOR EUROPE | DDDD |
| | FOR NORTH AMERICA | EEEE |
| | FOR JAPAN | FFFF |

IMAGE FORMING APPARATUS, REPLACEMENT DEVELOPING COMPONENT, AND METHOD FOR CONTROLLING IMAGE FORMING APPARATUS

INCORPORATION BY REFERENCE

This application is based upon and claims the benefit of priority from the corresponding Japanese Patent Application No. 2020-177130 filed on Oct. 22, 2020, the contents of which are hereby incorporated by reference.

BACKGROUND

The present disclosure relates to an image forming apparatus that can be fitted with a replacement developing component for storing toner and to a replacement developing component that is fitted to an image forming apparatus. The present disclosure also relates to a method for controlling an image forming apparatus.

Image forming apparatuses that perform printing using toner are known. They include, for example, printers and multifunction peripherals. When printing is performed, toner is consumed. Some image forming apparatuses are fitted with a toner storage container for their replenishment with toner. When the toner storage container runs out of toner, it is replaced with a new toner storage container. Some image forming apparatuses sense their being fitted with a new toner storage container.

SUMMARY

According to one aspect of what is disclosed herein, an image forming apparatus includes an accommodating portion, a motor, and a development sensor. In the accommodating portion, a replacement developing component is fitted. The replacement developing component is fitted with a rotary member including an operating member, and stores toner. The motor rotates the rotary member on the replacement developing component fitted in the accommodating portion. When a new replacement developing component is fitted, the development sensor is not in contact with the operating member before the motor rotates the rotary member and is in contact with the operating member on the rotary member that has moved as the motor rotates. The development sensor outputs a first level when in contact with the operating member and outputs a second level when not in contact with the operating member.

This and other objects of the present disclosure, and the specific benefits obtained according to the present disclosure, will become apparent from the description of embodiments which follows.

BRIEF DESCRIPTION OF THE DRAWINGS

FIG. 9 is a diagram showing one example of judgment based on the development sensor according to the embodiment;

FIG. 11 is a diagram showing one example of full-load value data according to the embodiment.

DETAILED DESCRIPTION

Hereinafter, with reference to FIGS. 1 to 11, an embodiment of the present invention will be described. In the following description, a printer 100 will be taken as an example of an image forming apparatus. It should however be noted that all the features described in connection with the embodiment in terms of structures, arrangements, and the like are merely examples and are not meant to limit the scope of the disclosure.

(Outline of the Printer 100)

Figure 1:
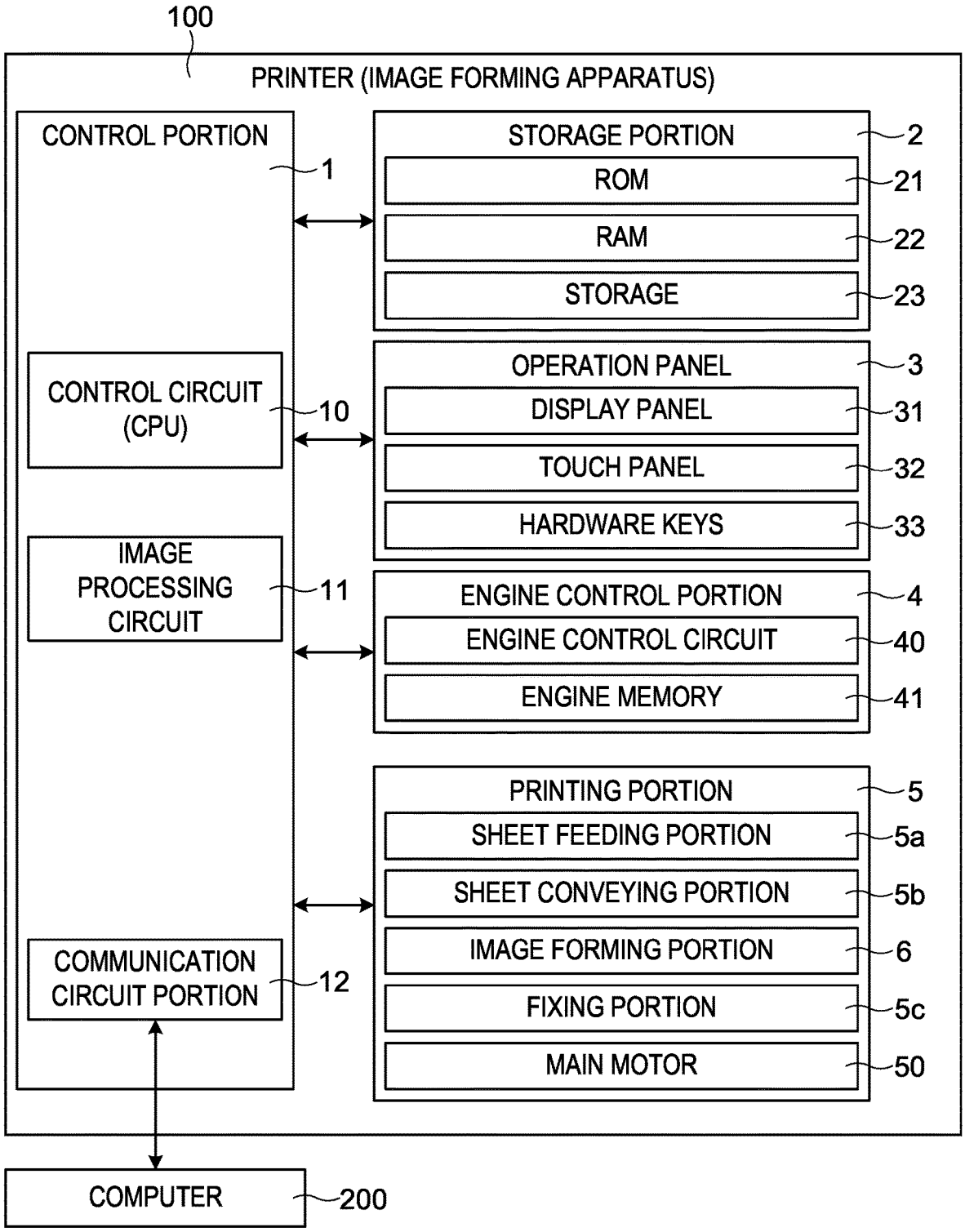
FIG. 1 is a diagram showing one example of a printer according to an embodiment.

Next, with reference to FIG. 1, an outline of the printer 100 according to the embodiment will be described. FIG. 1 is a diagram showing one example of the printer 100 according to the embodiment.

The printer 100 includes a control portion 1, a storage portion 2, an operation panel 3, an engine control portion 4, and a printing portion 5. The control portion 1 controls the operation of the printer 100. The control portion 1 includes a control circuit 10, an image processing circuit 11, and a communication circuit portion 12. The control portion 1 is, for example, a circuit board. The control circuit 10 is a CPU. The control circuit 10 performs calculation and processing based on programs and data stored in the storage portion 2. The control circuit 10 controls the operation of different parts in the printer 100.

The communication circuit portion 12 includes a connector, a communication control circuit (communication IC), and a communication memory. The communication circuit portion 12 communicates with a computer 200. Based on communication software, the communication control circuit performs communication. The communication memory stores the communication software. The computer 200 is, for example, a PC or a server. The communication circuit portion 12 receives printing data transmitted from the computer 200. The printing data includes data such as print setting data and printing content coded in a page description language.

The image processing circuit 11 is, for example, an ASIC. An ASIC is an integrated circuit designed for image processing. Printing data includes data coded in a page description language. Based on the data, the image processing circuit 11 generates image data (raster data). The image processing circuit 11 performs image processing on the raster data in accordance with the print settings (setting data) on the computer 200. The image processing circuit 11 converts the raster data having undergone image processing to generate output image data.

The printer 100 includes, as the storage portion 2, a ROM 21 and a RAM 22. The printer 100 may include, as a storage portion 2, a storage 23. The storage 23 is, for example, either of an HDD and an SSD, or both of them. The storage portion 2 includes non-volatile and volatile storage devices.

The printer 100 includes an operation panel 3. The operation panel 3 includes a display panel 31, a touch panel 32, and hardware keys 33. The control portion 1 makes the display panel 31 display messages, setting screens, and software keys. Based on the output of the touch panel 32, the control portion 1 recognizes the operated software key. Based on signals output from the hardware keys 33, the control portion 1 recognizes the operated hardware key 33.

The printer 100 includes an engine control portion 4 and a printing portion 5. The engine control portion 4 is, for example, a circuit board. The engine control portion 4 includes an engine control circuit 40 and an engine memory 41. The engine control circuit 40 is, for example, a CPU. The engine memory 41 includes a RAM and a ROM. The engine control portion 4 controls the rotation of a motor included in the printing portion 5. The engine control portion 4 also controls sheet conveyance and toner image formation.

The printing portion 5 includes a sheet feeding portion 5*a*, a sheet conveying portion 5*b*, an image forming portion 6, and a fixing portion 5*c*. Based on instructions from the control portion 1, the engine control portion 4 controls the operation of the sheet feeding portion 5*a*, the sheet conveying portion 5*b*, the image forming portion 6, and the fixing portion 5*c*.

(Printing Portion 5)

Figure 2:
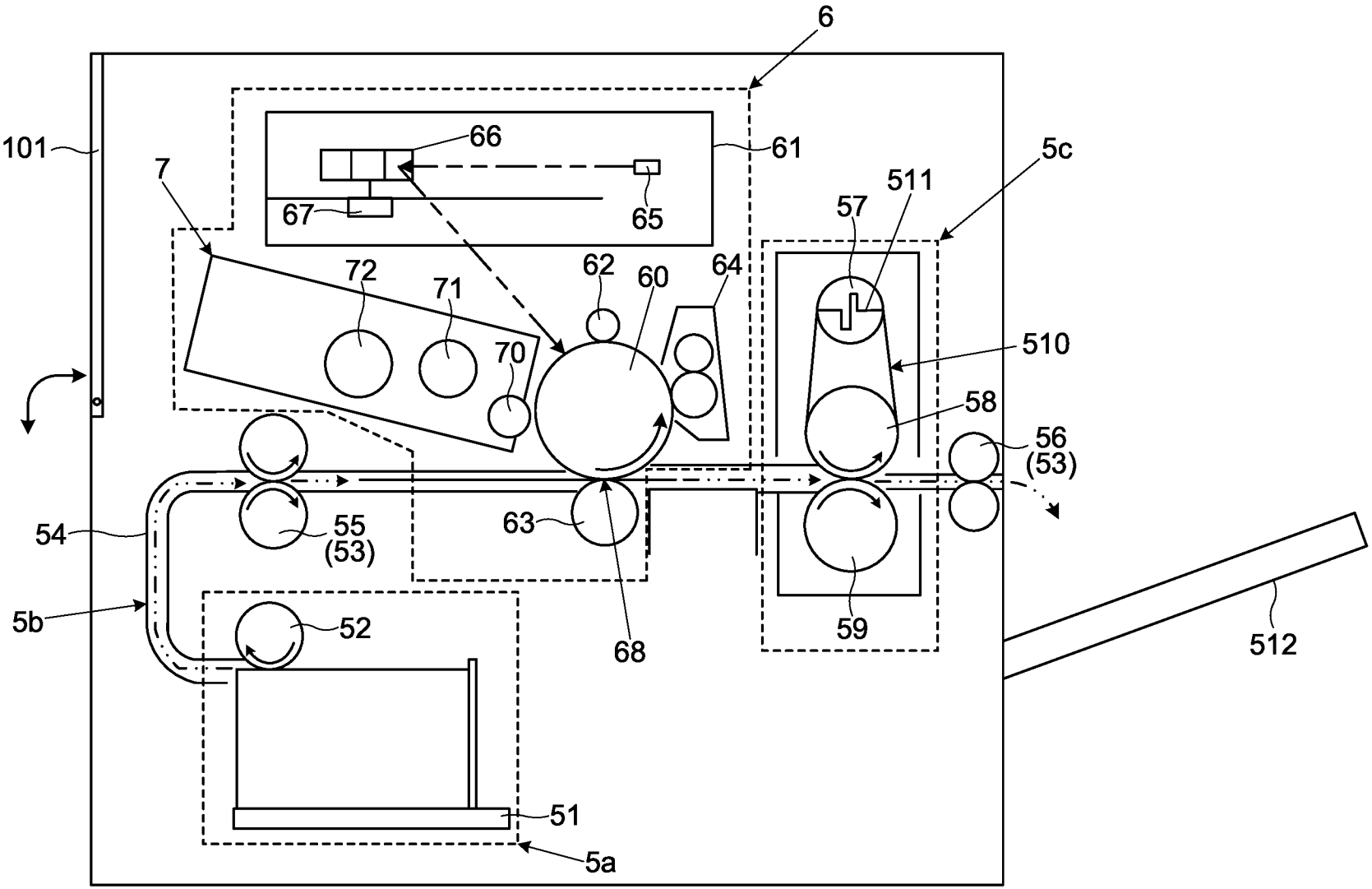
FIG. 2 is a schematic diagram showing one example of an image forming apparatus according to the embodiment.

Next, with reference to FIG. 2, one example of the printing portion 5 according to the embodiment will be described. FIG. 2 is a schematic diagram showing one example of the image forming apparatus according to the embodiment.

The sheet feeding portion 5*a* includes, for example, a sheet setting plate 51, a sheet feeding roller 52, and a sheet feeding motor (not shown). A bundle of sheets is set on the sheet setting plate 51. The sheet feeding motor rotates the sheet feeding roller 52. In a printing job, the engine control portion 4 rotates the sheet feeding roller 52 (sheet feeding motor). The rotating sheet feeding roller 52 feeds out the sheets set on the sheet setting plate 51 one after another. The sheets are fed out to the sheet conveying portion 5*b*.

The sheet conveying portion 5*b* includes a pair of conveying rollers 53, a conveying guide 54, and a conveying motor (not shown), all for conveying sheets. The conveying motor rotates the pair of conveying rollers 53. Thus the pair of conveying rollers 53 conveys sheets. FIG. 2 shows an example where, as the pair of conveying rollers 53, a pair of registration rollers 55 and a pair of discharge rollers 56 are provided.

The engine control portion 4 stops the pair of registration rollers 55 when the leading edge of a sheet reaches it. By thrusting the leading edge of the sheet onto the nip between the pair of registration rollers 55, a skew of the sheet is corrected. After skew correction, the engine control portion 4 rotates the pair of registration rollers 55 according to a toner image formed in the image forming portion 6 (on a photosensitive drum 60) so that the toner image is transferred to the sheet in an appropriate position on it. The sheet is thereby fed out through the pair of the registration rollers 55. The conveying guide 54 guides the conveyed sheet. The sheet is conveyed along a predetermined path.

The image forming portion 6 includes a photosensitive drum 60, an exposure device 61, a charging member 62, a replacement developing component 7, a transfer roller 63, and a cleaning device 64. Along the rotation direction of the photosensitive drum 60, the charging member 62, the replacement developing component 7, the transfer roller 63, and the cleaning device 64 are provided in this order around the photosensitive drum 60.

The photosensitive drum 60 is in a cylindrical shape. The surface (circumferential face) of the photosensitive drum 60 is a photosensitive layer. The photosensitive layer is, for example, a layer of amorphous silicon. The printing portion 5 includes a main motor 50 (corresponding to a motor) (see FIG. 1). The main motor 50 rotates the photosensitive drum 60. During printing, the engine control portion 4 rotates the main motor 50. During printing, the engine control portion 4 rotates the photosensitive drum 60 at a predetermined peripheral speed. The charging member 62 electrostatically charges the surface of the photosensitive drum 60 uniformly. The charging member 62 is, for example, a charging roller.

The exposure device 61 includes a semiconductor laser device 65 (laser diode). Based on output image data, the exposure device 61 turns on and off the semiconductor laser device 65. The exposure device 61 includes a polygon mirror 66 and a polygon motor 67. The polygon mirror 66 is in the shape of a polygonal column. The polygon mirror 66 reflects laser light from the semiconductor laser device 65. The reflected laser light travels toward the photosensitive drum 60. The polygon motor 67 rotates the polygon mirror 66. As the polygon mirror 66 rotates, the irradiation position of the laser light on the photosensitive drum 60 moves at a predetermined speed along the main scanning direction. By irradiation with laser light (an optical signal) from the exposure device 61, the photosensitive drum 60 is scanned and exposed to light. The electric charge on the part (the pixels) irradiated with laser light is neutralized. As a results, an electrostatic latent image corresponding to the output image data is formed on the circumferential face of the photosensitive drum 60.

The replacement developing component 7 stores toner. The replacement developing component 7 includes a developing roller 70, a fist stirring roller 71, and a second stirring roller 72. During printing, the developing roller 70 and the stirring rollers rotate. For example, the main motor 50 rotates the developing roller 70, the fist stirring roller 71, and the second stirring roller 72. For example, the shaft of each roller is fitted with a gear. A driving gear 50*b* fitted to the shaft of the rotor of the main motor 50 meshes with those gears. During printing, the engine control portion 4 rotates the main motor 50. Each stirring roller has a blade. These blades stir toner. By being stirred, the toner is charged.

The circumferential face of the developing roller 70 faces the circumferential face of the photosensitive drum 60. The rotary shaft of the developing roller 70 is parallel to the rotary shaft of the photosensitive drum 60. A gap is formed between the developing roller 70 and the photosensitive drum 60. The gap is very small. The gap is, for example, 1 mm or smaller. Around the circumferential face of the rotating developing roller 70, a thin layer of toner is formed. The toner flies off from the developing roller 70. The toner adheres to, of the circumferential face of the photosensitive drum 60, the part (pixels) where electric charge has been neutralized by exposure to light. With the toner held on the developing roller 70, the electrostatic latent image is developed. The photosensitive drum 60 rotates while carrying the developed toner image.

The circumferential face of the transfer roller 63 faces the circumferential face of the photosensitive drum 60. The rotary shaft of the transfer roller 63 is parallel to the rotary shaft of the photosensitive drum 60. The transfer roller 63 makes contact with the photosensitive drum 60. Where these make contact is a transfer nip 68. During printing, the photosensitive drum 60 and the transfer roller 63 rotate. A sheet passes through the transfer nip 68. During the passage, the toner image is transferred from the photosensitive drum 60 to the sheet. In the example in FIG. 2, the photosensitive drum 60 and the transfer roller 63 make contact with each other in the up-down direction. The cleaning device 64 collects toner that is left behind on the surface of the photosensitive drum 60 after transfer. The cleaning device 64 cleans the surface of the photosensitive drum 60.

The fixing portion 5*c* is provided downstream of the image forming portion 6 in the sheet conveying direction. The fixing portion 5*c* includes a fixing rotary member 7*a*. The fixing rotary member 7*a* includes a first heating roller 57, a second heating roller 58, and a pressing roller 59. A heating belt 510 is stretched around the first heating roller 57 and the second heating roller 58. The first heating roller 57 incorporates a heater 511. The heater 511 is, for example, an IH heater. The heating belt 510 is held between the second heating roller 58 and the pressing roller 59. The sheet to which the toner image has been transferred passes between the circumferential face of the heating belt 510 and the pressing roller 59. Heating melts the toner and pressing fixes the toner image to the sheet.

Downstream of the fixing portion 5*c* in the sheet conveying direction, the pair of discharge rollers 56 is provided. During printing, the engine control portion 4 rotates the pair of discharge rollers 56. A sheet that has passed through the pair of discharge rollers 56 is discharged onto a discharge tray 512.

(Fitting of the Replacement Developing Component 7)

Figure 3:
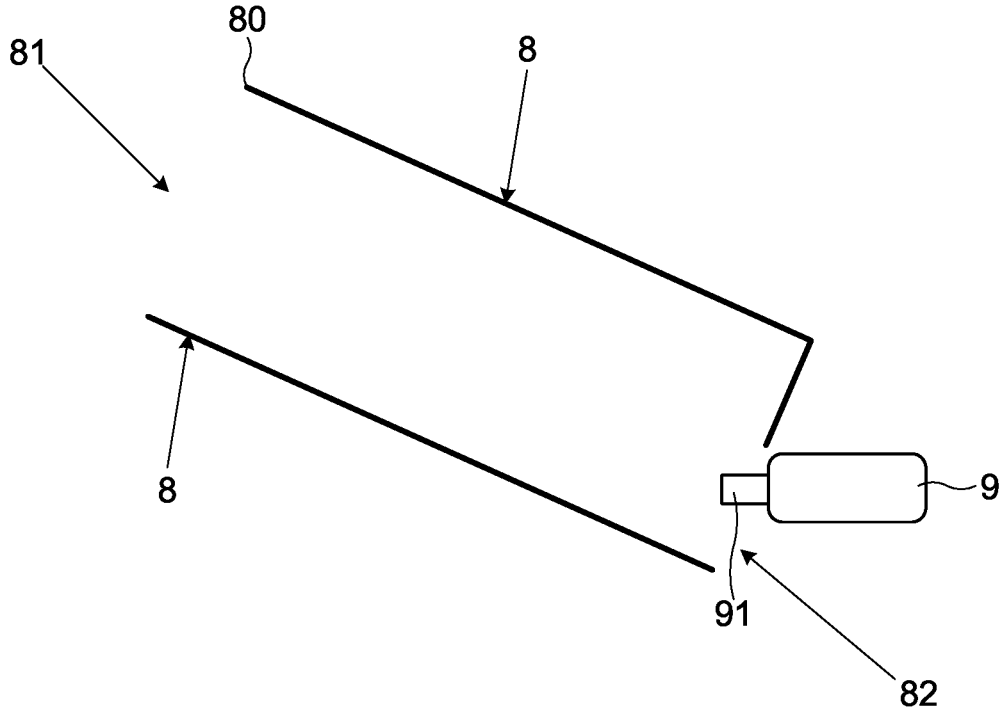
FIG. 3 is a diagram showing one example of fitting of a replacement developing component according to the embodiment.
Figure 4:
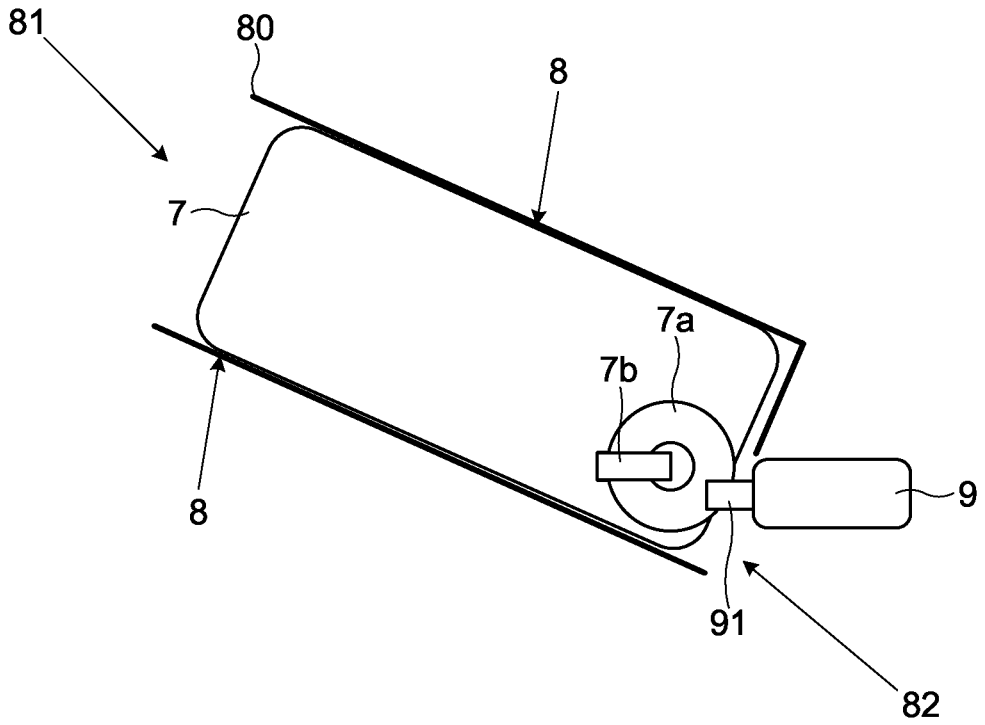
FIG. 4 is a diagram showing one example of fitting of the replacement developing component according to the embodiment.
Figure 5:
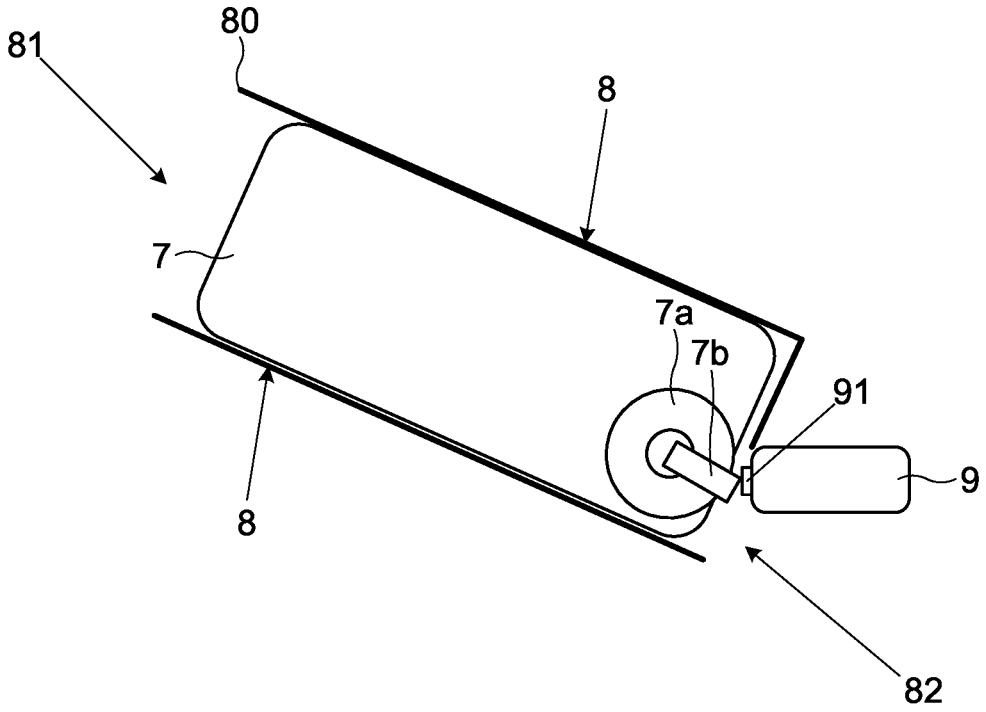
FIG. 5 is a diagram showing one example of fitting of the replacement developing component according to the embodiment.
Figure 6:
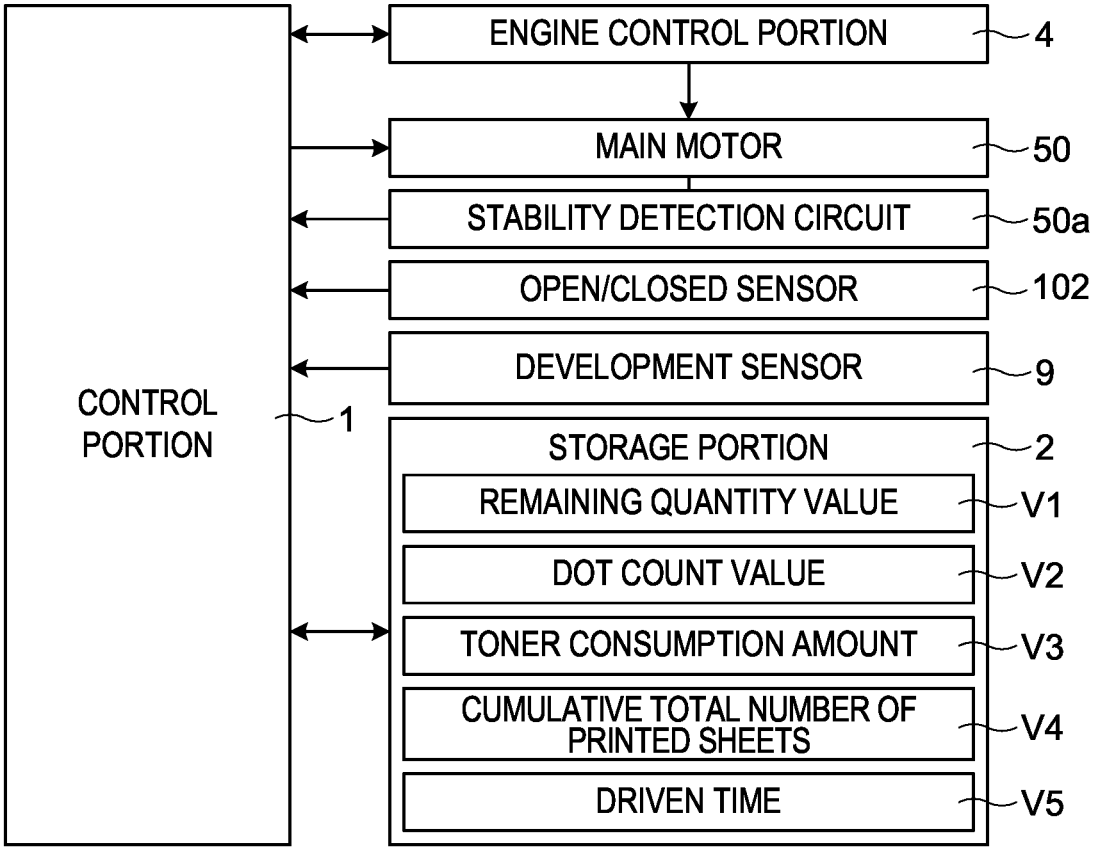
FIG. 6 is a diagram showing one example of the printer according to the embodiment.
Figure 7A:
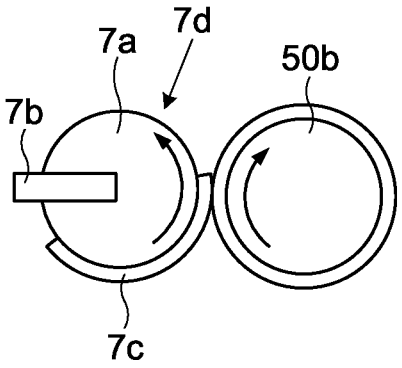
FIGS. 7A and 7B are diagrams showing one example of a rotary member and an operating member according to the embodiment.
Figure 7B:
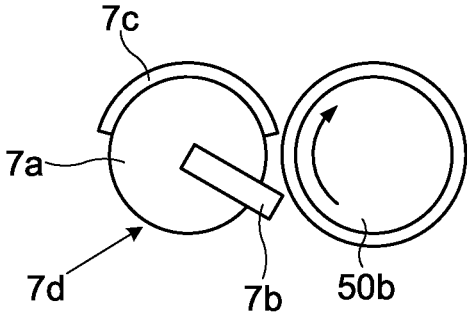

Next, with reference to FIGS. 3 to 6 and FIGS. 7A and 7B, one example of fitting of the replacement developing component 7 according to the embodiment will be described. FIGS. 3 to 5 are diagrams showing one example of fitting of the replacement developing component 7 according to the embodiment. FIG. 6 is a diagram showing one example of the printer 100 according to the embodiment. FIGS. 7A and 7B are diagrams showing one example of a rotary member 7*a* and an operating member 7*b* according to the embodiment.

First, the printer 100 includes a replacement cover 101 (see FIG. 2). In FIG. 2, one example of the opening/closing direction of the replacement cover 101 is indicated by a solid-line arrow. Before fitting or removing the replacement developing component 7, a user opens the replacement cover 101.

Inside the main body of the printer 100, an accommodating portion 8 is provided. The accommodating portion 8 is a part in (to) which the replacement developing component 7 is fitted. When fitting a new replacement developing component 7 to it, a user opens the replacement cover 101. Then, the new replacement developing component 7 is inserted in the accommodating portion 8. In this way, a new replacement developing component 7 is fitted to the printer 100.

When the toner in the replacement developing component 7 runs out (when a toner empty condition occurs), the old replacement developing component 7 is removed. A user opens the replacement cover 101 also when removing the old replacement developing component 7. Then, the user pulls out the old replacement developing component 7 from the accommodating portion 8. In this way, the old replacement developing component 7 is removed from the printer 100.

The accommodating portion 8 is in the shape of a box. The accommodating portion 8 includes an accommodating cylinder 80. The accommodating cylinder 80 may be a combination of a plurality of resin or metal plates. On the inner surface of the accommodating cylinder 80, a guide is formed which guides the replacement developing component 7 when it is fitted. For example, as the guide, a groove, a ridge, or a rail is formed. As shown in FIGS. 3 to 5, the accommodating portion 8 (accommodating cylinder 80) has a removal/insertion opening 81 at one face of it. In FIGS. 3 to 5, the removal/insertion opening 81 is at the left side face. When the replacement developing component 7 is fitted, it is inserted through the removal/insertion opening 81. The replacement developing component 7 is pushed in in the depth direction as seen from the removal/insertion opening 81. FIG. 3 shows one example of a state where the replacement developing component 7 is not fitted. FIG. 4 shows one example of a state where a new replacement developing component 7 is fitted. FIG. 5 shows one example of a state where the replacement developing component 7 is fitted and the rotary member 7*a* and the operating member 7*b* on the replacement developing component 7 are in an in-use position.

The accommodating portion 8 has an opening in part of its face on the far side as seen from the removal/insertion opening 81 (the face that faces the removal/insertion opening 81). Through this far-side opening 82, the developing roller 70 is exposed. Toner flies off from the exposed developing roller 70 toward the photosensitive drum 60. In FIGS. 4 and 5, the developing roller 70 is omitted from illustration.

The printer 100 includes a development sensor 9. The development sensor 9 is, for example, a push switch. The development sensor 9 is not limited to a push switch. Specifically, a movable portion 91 (switch portion) is provided in a part of the development sensor 9 at the side closer to the replacement developing component 7 and the accommodating portion 8. The movable portion 91 is urged in its projecting direction. For the urging, for example, an elastic member is provided inside the movable portion 91. The elastic member is, for example, a spring.

The output level of the development sensor 9 differs depending on whether the movable portion 91 is pressed (retracted) or not pressed (projected). In the following description, the output level of the development sensor 9 when the movable portion 91 of the development sensor 9 is pressed is referred to as a first level. The output level of the development sensor 9 (movable portion 91) when the development sensor 9 is not pressed is referred to as a second level. The first level is a level in a state where the switch is on. The second level is a level in a state where the switch is off.

If the first level is high level, the second level is low level. If the second level is high level, the first level is low level. As shown in FIG. 6, the output of the development sensor 9 is fed to the control portion 1.

Here, the replacement developing component 7 is fitted with the rotary member 7*a*. The rotary member 7*a* is, for example, a gear (see FIGS. 4 and 5). To the rotary member 7*a*, the operating member 7*b* is fitted. The operating member 7*b* is a lever which makes contact with the development sensor 9 to operate the movable portion 91. The operating member 7*b* may be fitted to the rotary shaft of the rotary member 7*a*. The operating member 7*b* is, for example, a cam. As the rotary member 7*a* rotates, the operating member 7*b* makes contact with the movable portion 91 of the development sensor 9.

In a new replacement developing component 7, the rotary member 7*a* and the operating member 7*b* are in an initial position. The initial position is a position in which the operating member 7*b* is not in contact with the development sensor 9 (movable portion 91). More specifically, the initial position is a position in which the operating member 7*b* is not in contact with the movable portion 91 and the output level of the development sensor 9 is the second level. FIG. 4 shows one example of a state where a new replacement developing component 7 is fitted. FIG. 4 shows one example of a state where the rotary member 7*a* and the operating member 7*b* on the replacement developing component 7 are in the initial position. In the initial position, as the main motor 50 rotates, a driving force from the main motor 50 is transmitted to the rotary member 7*a*. In coordination with the main motor 50, the rotary member 7*a* and the operating member 7*b* rotate.

When a new replacement developing component 7 is fitted, teeth provided around a circumferential face part of the rotary member 7*a* mesh with teeth on the driving gear 50*b* for transmitting the driving force from the main motor 50 to the rotary member 7*a*. The driving gear 50*b* may be fitted to the shaft of the main motor 50. The driving gear 50*b* may be a gear that couples to (meshes with) any gear that rotates by being driven by the driving force from the main motor 50. That is, one or a plurality of gears are provided which transmit the driving force from the main motor 50 to rotate the rotary member 7*a*.

When the main motor 50 starts to rotate, the rotary member 7*a* and the operating member 7*b* start to move from the initial position. The rotary member 7*a* and the operating member 7*b* rotate until they reach an in-use position. The in-use position is a position in which the operating member 7*b* is in contact with the movable portion 91. More specifically, the in-use position is a position in which the operating member 7*b* operates the movable portion 91 and the output level of the development sensor 9 is the first level. FIG. 5 shows one example of a state where the rotary member 7*a* and the operating member 7*b* on the replacement developing component 7 have completed moving to the in-use position.

The rotary member 7*a* and the operating member 7*b* are configured such that, once moved to the in-use position, they do not return to the initial position; they are configured also such that they do not push the movable portion 91 in more than necessary. With reference to FIGS. 7A and 7B, one example of a mechanism that prevents the rotary member 7*a* and the operating member 7*b* from returning to the initial position will be described.

FIGS. 7A and 7B each show a pair of the driving gear 50*b* and the rotary member 7*a*. FIG. 7A shows a state where the rotary member 7*a* and the operating member 7*b* are in the initial position. In other words, FIG. 7A shows a state immediately after a new replacement developing component 7 is fitted. FIG. 7B shows a state where the rotary member 7*a* and the operating member 7*b* have completed moving to the in-use position.

As shown in FIGS. 7A and 7B, for example, the rotary member 7*a* has no teeth in a part of its circumference. That is, the circumferential face of the rotary member 7*a* has two parts: a part with teeth (toothed part 7*c*) and a part without teeth (bare part 7*d*). In FIGS. 4 and 5, for the sake of convenience, the teeth on the rotary member 7*a*, the toothed part 7*c*, and the bare part 7*d* are omitted from illustration.

In the new replacement developing component 7, the rotary member 7*a* is at a position (at an angle) where the toothed part 7*c* meshes with the driving gear 50*b*. As the main motor 50 rotates, the driving gear 50*b* rotates. In coordination with the rotation of the driving gear 50*b*, also the operating member 7*b* rotates. When the rotary member 7*a* rotates up to the end of the toothed part 7*c*, the rotary member 7*a* no longer rotates any further. The position at which the rotary member 7*a* stops rotating is the in-use position. The main motor 50 rotates only in a predetermined direction, and it does not rotate reversely. Thus, the rotary member 7*a* and the operating member 7*b* do not return to the initial position (see FIG. 7B). Even if the operating member 7*b* tends to continue rotating, without teeth it cannot rotate beyond the in-use position. The operating member 7*b* does not push the movable portion 91 of the development sensor 9 more than necessary.

(Judgment Based on the Development Sensor 9)

Figure 8:
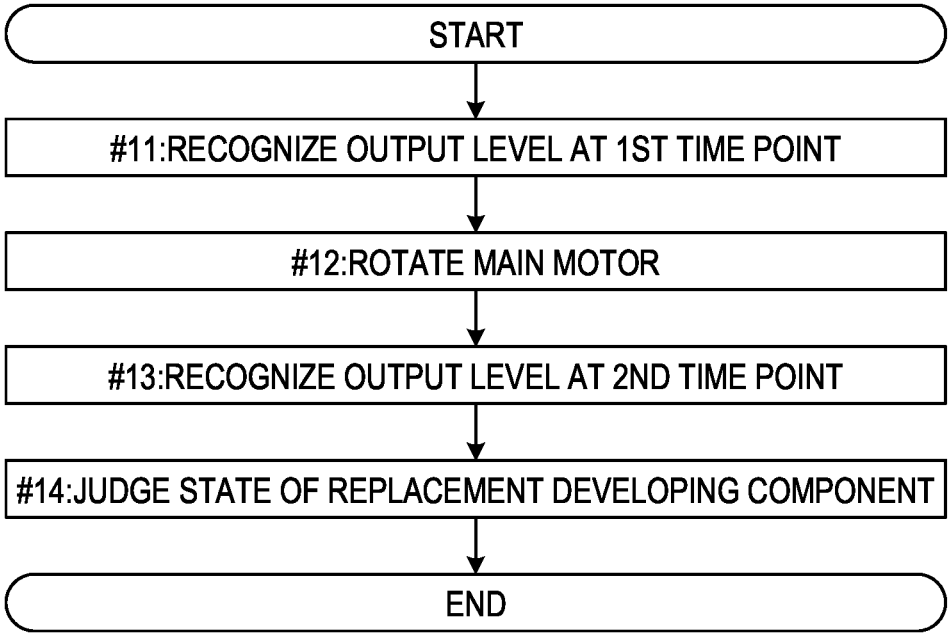
FIG. 8 is a diagram showing one example of judgment based on a development sensor according to the embodiment.

With reference to FIGS. 8 and 9, one example of judgment based on the development sensor 9 according to the embodiment will be described. FIGS. 8 to 9 are diagrams showing one example of judgment based on the development sensor 9 according to the embodiment.

Based on the output from the development sensor 9 at first and second time points, the control portion 1 judges (senses) whether the replacement developing component 7 is fitted or not, and also whether the fitted replacement developing component 7 is a new one or not. Furthermore, based on the output from the development sensor 9, the control portion 1 judges whether the replacement developing component 7 is in an irregular condition or not. The control portion 1 makes three judgments with a single sensor.

The procedure in FIG. 8 starts when the state of the replacement developing component 7 starts to be judged. A trigger (starting condition) for the judgment of the state is prescribed. Judgment can be triggered by completion of the starting up of the control portion 1 after the turning on of the main power. This is because the replacement developing component 7 may be replaced while the main power is off. Or, judgment may be triggered by the closing of the replacement cover 101. This is because the replacement cover 101 may be opened and closed for replacement of the replacement developing component 7. A multifunction peripheral includes a sensor (open/closed sensor 102) for sensing whether the replacement cover 101 is open or closed (see FIG. 6). Based on the output from the open/closed sensor 102, the control portion 1 can recognize when the replacement cover 101 is opened and closed.

Judgment may be triggered by the restarting of the control portion 1 after the cancellation of a power saving mode (sleep mode). Or, Judgment may be triggered by the restarting of the control portion 1 after the cancellation of an OFF mode (sleep mode). This is because the replacement developing component 7 may be replaced during the power saving mode or the OFF mode.

The power saving mode and the OFF mode are both modes for suppressing power consumption in the printer 100. The printer 100 includes a power supply control circuit (not shown). The power supply control circuit controls the supply of electric power to components, circuits, and circuit boards in the printer 100. The power supply control circuit reduces electric power consumption to a higher degree in the OFF mode than in the power saving mode. For example, in the power saving mode, to allow recognition of the reception of a print request from the computer 200, the power supply control circuit keeps supplying the communication circuit portion 12 with electric power. On the other hand, in the OFF mode, the power supply control circuit does not supply the communication circuit portion 12 with electric power.

First, after judgment is started, the control portion 1 rotates the main motor 50. For example, the control portion 1 requests the engine control portion 4 to rotate the main motor 50. The engine control portion 4 rotates the main motor 50. Then, the control portion 1 recognizes the output level of the development sensor 9 at a first time point (step #11). The first time point is any time point after the starting condition of state judgment is met until the main motor 50 starts to rotate. Next, after the output level at the first time point is confirmed, the control portion 1 rotates the main motor 50 (step #12). After the main motor 50 starts to rotate, the control portion 1 recognizes the output level of the development sensor 9 at the second time point (step #13).

The second time point is the time point after the main motor 50 starts to rotate. Specifically, the second time point is set at a time point after the control portion 1 recognizes that the main motor 50 is stabilized. Here, the printer 100 includes a stability detection circuit 50*a* (see FIG. 6). The stability detection circuit 50*a* outputs a signal that indicates that the rotation speed of the main motor 50 has reached a prescribed stable speed. This signal is fed to the control portion 1. When the stability detection circuit 50*a* outputs the signal indicating that the rotation speed has reached a stable speed, the control portion 1 recognizes that the main motor 50 is stabilized. The second time point is determined with consideration given to the length of time after the main motor 50 starts to rotate until the rotary member 7*a* and the operating member 7*b* in the initial position reach the in-use position. Take that into consideration, the second time point is set at a time point when a predetermined time has passed since the control portion 1 recognizes that the main motor 50 is stabilized. For example, a predetermined time is set to be any length of time within the range from one to several seconds.

Based on the output levels of the development sensor 9 at the first time point and at the second time point, the control portion 1 judges the state of the replacement developing component 7 (step #14 to END). There are following four patterns in the output level at the first time point and the second time point.

(Pattern 1) at the first time point: the second level, at the second time point: the first level (Pattern 2) at the first time point: the first level, at the second time point: the first level (Pattern 3) at the first time point: the second level, at the second time point: the second level (Pattern 4) at the first time point: the first level, at the second time point: the second level Here, the first level indicates the level when the operating member 7*b* is in contact with the development sensor 9 (when the switch is ON). The second level indicates the level when the operating member 7*b* is not in contact with the development sensor 9 (when the switch is OFF).

(1) Pattern 1

The output level at the first time point: the second level (the switch is OFF)

The output level at the second time point: the first level (the switch is ON)

In this pattern, the control portion 1 judges that the replacement developing component 7 is fitted and in addition that a new replacement developing component 7 has been fitted. The first level is the level when the operating member 7*b* is in contact with the development sensor 9. When the operating member 7*b* changes from a state where the operating member 7*b* is not in contact with the development sensor 9 to a state where it is in contact with the development sensor 9, the output level of the development sensor 9 changes in this way. In this case, the control portion 1 judges that a new replacement developing component 7 is fitted.

(2) Pattern 2

The output level at the first time point: the first level (the switch is ON)

The output level at the second time point: the first level (the switch is ON)

In this pattern, the control portion 1 judges that the replacement developing component 7 is fitted and, in addition, the replacement developing component 7 is not a new one. The output level of the development sensor 9 is like this when the operating member 7*b* is in contact with the development sensor 9 and the position of the rotary member 7*a* and the operating member 7*b* do not change from the in-use position. When the output level of the development sensor 9 is the first level both at the first and second time points, the control portion 1 judges that the replacement developing component 7 is fitted but it is not a new one.

(3) Pattern 3

The output level at the first time point: the second level (the switch is OFF)

The output level at the second time point: the second level (the switch is OFF)

In this pattern, the control portion 1 judges that no replacement developing component 7 is fitted. When no replacement developing component 7 is fitted, both at the first and second time points, the output level is the second level.

When it is judged that no replacement developing component 7 is fitted, the control portion 1 may make the display panel 31 display a first message. The first message is a message that urges a user to fit the replacement developing component 7. For example, the first message can be character strings such as "Please fit the developing unit (replacement developing component 7)".

(4) Pattern 4

The output level at the first time point: the first level (the switch is ON)

The output level at the second time point: the second level (the switch is OFF)

In this pattern, the control portion 1 recognizes an irregular condition. From this pattern of change in the output level, it is not possible to judge whether the replacement developing component 7 is present or not, and also whether it is new or not. When the replacement developing component 7 is not fitted properly, the output level can change in this way. On recognizing an irregular condition, the control portion 1 can make the display panel 31 display a second message. The second message is a message that notifies a user that the replacement developing component 7 is in an irregular condition. For example, the second message can be character strings such as "Please insert the developing unit (replacement developing component 7) completely".

(Toner Related Values Stored in the Storage Portion 2)

Next, with reference to FIG. 6, one example toner related values stored in the storage portion 2 according to the embodiment will be described. A replacement component in the image forming apparatus may be fitted with a management memory. For example, a semiconductor memory may be fitted to the replacement component for management. Or, when information is exchanged on a wireless basis, an IC tag (wireless tag) including a readable-writable memory may be fitted. Information for judging whether a component is genuine or not may be stored in the memory. Usage of the replacement component may be stored in the management memory.

However, circuits, circuit boards, and conductors (in case of wireless communication, also an antenna) for communication with the management memory need to be provided inside the main body of the image forming apparatus. Use of a management memory leads to an increase in the manufacturing cost and the designing effort of the replacement component and the image forming apparatus.

The replacement developing component 7 according to the embodiment has no storage medium (management memory). The printer 100 has no read and write circuit for a management memory. Information on the usage of the replacement developing component 7 is stored in a non-volatile manner in the storage portion 2 (for example, the storage 23) in the main body of the printer 100. For example, the control portion 1 makes the storage portion 2 store, as information on the usage of the replacement developing component 7, a remaining quantity value V1, a dot count value V2, a toner consumption amount V3, a cumulative total number of printed sheets V4, and a driven time V5 (see FIG. 6) in a non-volatile manner. Every time a printing job is complete, the control portion 1 updates these values (usage information).

The remaining quantity value V1 is a value that indicates the current amount of remaining toner stored in the replacement developing component 7 fitted. The dot count value V2 is a cumulative total number of pixels at which toner has been attached in a printing job after the replacement developing component 7 was fitted. The toner consumption amount V3 is based on a value obtained by multiplying the dot count value V2 by the standard toner consumption amount V3 per pixel. The cumulative total number of printed sheets V4 is a cumulative total number of sheets printed in a printing job after the replacement developing component 7 was fitted. The drive time V5 is a cumulative total length of time during which the main motor 50 has been rotated after the replacement developing component 7 was fitted. The remaining quantity value V1 decreases gradually and the toner consumption amount V3, the cumulative total number of printed sheets V4, and the drive time V5 increase gradually.

The control portion 1 uses information stored in the storage portion 2. For example, the control portion 1 calculates a toner remaining ratio based on the formula below. The control portion 1 makes the display panel 31 display the calculated toner remaining ratio.

$$\text{Toner Remaining Ratio}=(A-B)/A \quad \text{(Formula)}$$

Here, A represents the amount of toner stored in a new replacement developing component 7 (the remaining quantity value V1 at full load), and B represents the toner consumption amount V3.

Here, when the value of (A−B) in the above formula becomes smaller than a prescribed empty value, the control portion 1 may make the display panel 31 display a toner empty indication (toner has run out). Likewise, when the value resulting of (A−B) is larger than the empty value but smaller than a prescribed toner low value, the control portion 1 may make the display panel 31 display a toner low indication (toner will shortly need to be replaced).

In this way, information on the usage of the replacement developing component 7 is held and used in the printer 100 (main body). Thus, when a new replacement developing component 7 is fitted, the information in the storage portion 2 (the remaining quantity value V1, the dot count value V2, the toner consumption amount V3, the cumulative total number of printed sheets V4, and the drive time V5) need to be reset. Then, on judging that a new replacement developing component 7 is fitted, the control portion 1 sets the remaining quantity value V1 in the storage portion 2 at the value of the amount of toner stored in the new replacement developing component 7 (a full-load value).

(Procedure on Judging that a New Replacement Developing Component is Fitted)

Figure 10:
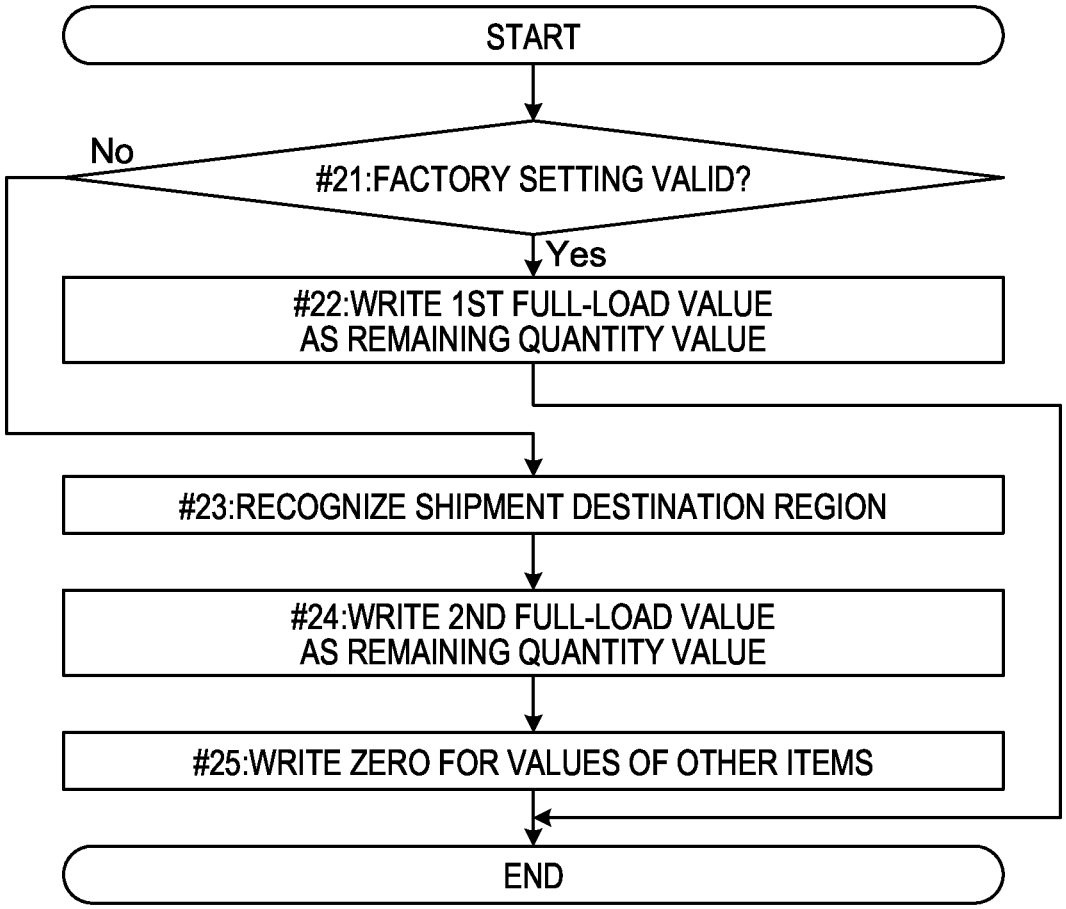
FIG. 10 is a diagram showing one example of a procedure performed when it is judged that a new replacement developing component is fitted.

Next, with reference to FIG. 10, one example of a procedure performed when it is judged that a new replacement developing component 7 is fitted to the printer 100 according to the embodiment. FIG. 10 is a diagram showing one example of the procedure performed when it is judged that a new replacement developing component 7 is fitted. FIG. 11 is a diagram showing one example of full-load value data D1 according to the embodiment.

The procedure in FIG. 10 starts when it is judged that a new replacement developing component 7 is fitted. First, the control portion 1 checks whether a factory setting is valid or not (step #21). Specifically, the control portion 1 checks the value in the storage area (factory setting flag) that indicates whether the factory setting of the storage portion 2 is valid or invalid. The factory setting is a setting that is made when the printer 100 is shipped from the factory. A person in charge of shipping performs specific operation on the operation panel 3. When the specific operation is performed, the control portion 1 writes in that area a value that indicates that the factory setting is valid.

After shipment, on judging that the printer 100 is unpacked and installed, that the power is turned on, and that a new replacement developing component 7 is fitted, the control portion 1 automatically makes the factory setting invalid. The control portion 1 writes in the above-mentioned area in the storage portion 2 a value indicating that the factory setting is invalid.

Here, the printer 100 is shipped together with a new replacement developing component 7. For example, a new replacement developing component 7 is included in the crate of the printer 100. This makes it possible to start using (printing with) the printer 100 immediately after installation. In the following description, the replacement developing component 7 shipped together is referred to as a factory-supplied component.

In some cases a replacement developing component 7 that is distributed in the shipment destination region (i.e., that is generally available and is purchased by a user) can, when it is brand-new, have a toner amount different from that in the factory-supplied component. In the following description, a replacement developing component 7 which has an initial toner amount different from that in the factory-supplied component and which is generally available and is purchased by a user is referred to as a generally distributed component. That is, the factory-supplied component and the generally distributed component may have different remaining quantity values V1 at full load. In many cases, the initial toner amount in the factory-supplied component is smaller than that in the generally distributed component.

Furthermore, the initial (full-load) toner amount of the generally distributed component may vary depending on the shipment destination. For example, the initial toner amount in the generally distributed component is determined for each shipment destination with consideration given to the tendencies in toner consumption in the shipment destination.

The storage portion 2 stores the full-load value data D1 in a non-volatile manner so that a proper remaining quantity value V1 can be set when a new replacement developing component 7 is fitted. FIG. 11 shows one example of the full-load value data D1. The full-load value data D1 is data that defines the amount of toner stored in a new factory-supplied component. The full-load value data D1 in FIG. 11 shows an example where the toner amount in the factory-supplied component is equal regardless of the shipment destination. The full-load value data D1 is data that defines for each shipment destination the amount of toner stored in the new generally distributed component.

When the factory setting is valid (Yes in step #21), the control portion 1 writes as the remaining quantity value V1 the toner amount (a first full-load value) stored in the new factory-supplied component to the storage portion 2 (step #22). On the other hand, when the factory setting is invalid (No in step #21), the control portion 1 recognizes the destination region (step #23). In the storage portion 2, the destination region of the printer 100 is written in advance (see FIG. 6). The control portion 1 checks the data in the storage portion 2 and recognizes the destination region of the printer 100. Then, the control portion 1 writes to the storage portion 2 as the remaining quantity value V1 the toner amount (a second full-load value) stored in the generally distributed component in the corresponding destination region (step #24). The control portion 1 refers to the full-load value data D1. The control portion 1 takes as the second full-load value the amount of toner stored in the new generally-distributed component in the corresponding destination.

After step #22 or step #24, the control portion 1 writes zero for (resets) the values of the other items (the dot count value V2, the toner consumption amount V3, the cumulative total number of printed sheets V4, and the drive time V5) (step #25). Then, the control portion 1 finishes the procedure that it performs on judging that a new component is fitted (END).

The image forming apparatus (printer 100) includes the accommodating portion 8, the motor (main motor 50), and the development sensor 9. The replacement developing component 7 is fitted in the accommodating portion 8. The replacement developing component 7 is fitted with the rotary member 7*a* which stores toner and includes an operating member 7*b*. The motor rotates the rotary member 7*a* on the replacement developing component 7 fitted in the accommodating portion 8. When a new replacement developing component 7 is fitted, the development sensor 9 is not in contact with the operating member 7*b* before the motor rotates the rotary member 7*a*. The development sensor 9 makes contact with the operating member 7*b* on the rotary member 7*a* that has moved as the motor rotates. The development sensor 9 outputs the first level when the operating member 7*b* is in contact and outputs the second level when the operating member 7*b* is not in contact.

When a new replacement developing component 7 is fitted, the development sensor 9 can output different output levels before and after the rotation of the motor. Thus, it is possible to sense whether a new replacement developing component 7 is fitted or not. When the replacement developing component 7 is not fitted, the output level of the development sensor 9 remains the second level. Thus, it is also possible to sense whether the replacement developing component 7 is present or not. It is possible to sense with a single sensor whether the replacement developing component 7 is present and whether a new replacement developing component 7 is fitted.

A compact memory for management may be fitted to the replacement developing component 7. The management memory is, for example, an IC chip or a compact semiconductor memory. The management memory may store, for example, information for judging whether the component is genuine or not. It stores, for example, the model number and the manufacturing number of the replacement developing component 7. It is possible to make the management memory store the amount of toner used and the cumulative total number of printed sheets V4. It is also possible to make the management memory store information for judging whether the replacement developing component 7 is new or not. However, in the printer 100 (image forming apparatus according to this embodiment), such a management memory is not necessary. Without a memory, it is possible to accurately sense whether the replacement developing component 7 is present or absent and whether a new replacement developing component 7 is fitted or not. Thus, it is not necessary for the image forming apparatus to incorporate hardware (a reader and a writer) for reading from and writing to the management memory. That is, it is not necessary to provide a special hardware. This helps reduce the manufacturing cost of the image forming apparatus.

The printer 100 (image forming apparatus) includes a control portion 1 which is fed with the output of the development sensor 9 and which, based on the output level of the development sensor 9 at the first time point before the motor rotates and at the second time point after the motor rotates, judges whether the replacement developing component 7 is fitted or not and whether a new replacement developing component 7 is fitted or not. Based on the output of the development sensor 9, it is possible to sense whether the replacement developing component 7 is present and whether a new replacement developing component 7 is fitted. It is possible to make a plurality of judgments with a single sensor.

Known image forming apparatuses have at least one sensor dedicated to sensing that a new component is fitted. Known image forming apparatuses have, other than the new component detection sensor, a sensor related to development. For example, a sensor is provided which senses whether a development-related member is fitted or not (the presence or absence of the development-related member). A plurality of sensors may be provided which are dedicated to sensing that a new component is fitted. Some known image forming apparatuses separately have a sensor which senses that the image forming unit is fitted and a toner end sensor which senses the amount of remaining toner in the developing portion. Known image forming apparatuses often require a number of sensors. With a number of sensors, it may inconveniently be difficult to suppress the manufacturing cost of the image forming apparatus.

In the image forming apparatus according to the present disclosure, without providing a storage device such as an IC chip in the replacement developing component, it is possible to sense with a single sensor whether the replacement developing component is present or absent and whether a new replacement developing component is fitted or not.

After the motor starts rotating, the control portion 1 recognizes that the rotation of the motor is stabilized. The control portion 1 takes the time point at which a predetermined time has passed after the rotation of the motor was stabilized as the second time point. It is possible to check the output level of the development sensor 9 after the rotation of the motor is stabilized. When a new replacement developing component 7 is fitted, it is possible to check the output level of the development sensor 9 after the motor starts to rotate and the operating member 7*b* makes contact with the development sensor 9. It is possible to accurately sense whether a new replacement developing component 7 is fitted or not.

When the output level at the first time point is the second level and the output level at the second time point is the first level, the control portion 1 judges that the replacement developing component 7 is fitted and in addition that a new replacement developing component 7 is fitted. Thus, it is possible to accurately sense whether a new replacement developing component 7 is fitted.

The printer 100 (image forming apparatus) includes the storage portion 2 that stores the remaining quantity value V1 indicating the current remaining quantity of toner stored in the replacement developing component 7. On judging that a new replacement developing component 7 is fitted, the control portion 1 sets the remaining quantity value V1 in the storage portion 2 at a full-load value that is the value of the amount of toner stored in a new replacement developing component 7. When a new replacement developing component 7 is fitted, it is possible to automatically reset the remaining quantity value V1. It is possible to automatically update the remaining quantity value V1 to an appropriate value when triggered by replacement with a new component. It is possible to manage the remaining quantity of toner correctly.

On judging, for the first time, that a new replacement developing component 7 is fitted, the control portion 1 sets the remaining quantity value V1 in the storage portion 2 at the first full-load value. On recognizing, for the second time or thereafter, that a new replacement developing component 7 is fitted, the control portion 1 sets the remaining quantity value V1 in the storage portion 2 at the second full-load value. The first full-load value is smaller than the second full-load value. At the time of shipment from a factory, a replacement developing component 7 may be shipped together with a product. The factory-supplied replacement developing component 7 can have an initial toner amount (the toner amount at full load) different from that in a user-purchased (generally-distributed) replacement developing component 7. Even when there is a difference in the amount of toner stored depending on the kind of the replacement developing component 7, it is possible to set a proper remaining quantity value V1.

The storage portion 2 stores the shipment destination. The control portion 1 sets the second full-load value in accordance with the shipment destination stored in the storage portion 2. Depending on the destination region (export destination, shipment destination) of the image forming apparatus, the amount of toner stored in a new replacement developing component 7 (the toner amount at full load) may vary. Even so, it is possible to set an appropriate remaining quantity value V1 in accordance with the shipment destination.

When the output level at the first time point is the first level and the output level at the second time point is the first level, the control portion 1 judges that the replacement developing component 7 is fitted and in addition that the replacement developing component 7 is not brand-new. It is possible to sense that the replacement developing component 7 is fitted but it is not brand-new. It is possible to sense, with a single sensor (development sensor 9), whether the replacement developing component 7 is present or not and whether it is new or not.

When the output level at the first time point is the second level and the output level at the second time point is the second level, the control portion 1 judges that the replacement developing component 7 is not fitted. It is possible to judge (sense) that the replacement developing component 7 is not fitted. It is possible to accurately sense, with a single sensor (development sensor 9), even whether the replacement developing component 7 is present or not.

When the output level at the first time point is the first level and the output level at the second time point is the second level, the control portion 1 recognizes an irregular condition. It is possible to recognize (sense) an irregular condition in connection with the replacement developing component 7.

The present disclosure can also be understood as a disclosure of a replacement developing component 7. The replacement developing component 7 according to the embodiment can be fitted in the accommodating portion 8 in the image forming apparatus (printer 100) described above. The replacement developing component 7 is fitted with the rotary member 7*a* including the operating member 7*b*, and stores toner. Once the rotary member 7*a* rotates until the operating member 7*b* makes contact with the development sensor 9 in the image forming apparatus, it no longer allows the operating member 7*b* to return to the initial position before the rotation. It is possible to provide a replacement developing component 7 which allows, with a single sensor, sensing whether it is fitted or not and whether it is brand-new or not. Once the operating member 7*b* is used, it does not return to the initial position. This helps prevent erroneous detection as to whether a new component is fitted.

The replacement developing component 7 includes the developing roller 70. The developing roller 70 holds a thin layer of toner, feeds the toner to an electrostatic latent image, and develops the electrostatic latent image with the toner. The replacement developing component 7 may include the developing roller 70. It is possible to replace the developing roller 70 together when replacing the replacement developing component 7.

The embodiment described above is in no way meant to limit the present disclosure, which thus allows for many modifications and variations within the spirit of the present disclosure.

The description of the embodiments above deals with an example where the replacement developing component 7 includes the developing roller 70. However, the replacement developing component 7 may not include the developing roller 70. The present disclosure is also suitable for a toner storage container (toner container).

The present disclosure is applicable to an image forming apparatus that can be fitted with a replacement developing component for storing toner, and also to a replacement developing component that is fitted to an image forming apparatus.

What is claimed is:

1. An image forming apparatus comprising:

an accommodating portion in which a replacement developing component which is fitted with a rotary member including an operating member and which stores toner is fitted;

a motor which rotates the rotary member on the replacement developing component fitted in the accommodating portion;

a development sensor which, when a new replacement developing component is fitted, is not in contact with the operating member before the motor rotates the rotary member and is in contact with the operating member on the rotary member that has moved as the motor rotates, the development sensor outputting a first level when in contact with the operating member, the development sensor outputting a second level when not in contact with the operating member; and a control portion which is fed with an output of the development sensor and which, based on output levels of the development sensor at a first time point before the motor rotates and at a second time point after the motor rotates, judges whether the replacement developing component is fitted or not and whether a new replacement developing component is fitted or not.

2. The image forming apparatus according to claim 1, wherein the control portion, after the motor starts rotating, recognizes that rotation of the motor is stabilized and takes as the second time point a time point at which a predetermined time has passed after recognizing that the rotation of the motor was stabilized.

3. The image forming apparatus according to claim 1, wherein when the output level at the first time point is the second level and the output level at the second time point is the first level, the control portion judges that the replacement developing component is fitted and in addition that a new replacement developing component is fitted.

4. The image forming apparatus according to claim 1, further comprising a storage portion that stores a remaining quantity value indicating a current remaining quantity of toner stored in the replacement developing component, wherein on judging that a new replacement developing component is fitted, the control portion sets the remaining quantity value in the storage portion at a full-load value that is a value of an amount of toner stored in the new replacement developing component.

5. The image forming apparatus according to claim 4, wherein the control portion, on judging, for a first time, that a new replacement developing component is fitted, sets the remaining quantity value in the storage portion at a first full-load value and, on recognizing, for a second time or thereafter, that a new replacement developing component is fitted, sets the remaining quantity value in the storage portion at a second full-load value, and the first full-load value is smaller than the second full-load value.

6. The image forming apparatus according to claim 5, wherein the storage portion stores a shipment destination region, and the control portion sets the second full-load value in accordance with the shipment destination region stored in the storage portion.

7. The image forming apparatus according to claim 1, wherein when the output level at the first time point is the first level and the output level at the second time point is the first level, the control portion judges that the replacement developing component is fitted and in addition that the replacement developing component is not brand-new.

8. The image forming apparatus according to claim 1, wherein when the output level at the first time point is the second level and the output level at the second time point is the second level, the control portion judges that the replacement developing component is not fitted.

9. The image forming apparatus according to claim 1, wherein when the output level at the first time point is the first level and the output level at the second time point is the second level, the control portion recognizes an irregular condition.

10. The image forming apparatus according to claim 1, wherein once the rotary member rotates until the operating member makes contact with the development sensor in the image forming apparatus, the rotary member no longer allows the operating member to return to an initial position before the rotation.

11. The image forming apparatus according to claim 1, wherein the replacement developing component includes a developing roller, and the developing roller holds a thin layer of the toner, feeds the toner to an electrostatic latent image, and develops the electrostatic latent image with the toner.

12. A replacement developing component which stores toner and which is fittable in an accommodating portion in an image forming apparatus comprising a rotary member including an operating member, wherein once the rotary member is rotated by a motor provided in the image forming apparatus until the operating member makes contact with a development sensor in the image forming apparatus, the rotary member no longer allows the operating member to return to an initial position before the rotation.

13. The replacement developing component according to claim 12, further comprising a developing roller, wherein the developing roller holds a thin layer of the toner, feeds the toner to an electrostatic latent image, and develops the electrostatic latent image with the toner.

14. A method for controlling an image forming apparatus that includes an accommodating portion in which a replacement developing component which is fitted with a rotary member including an operating member and which stores toner is fitted, a motor which rotates the rotary member on the replacement developing component fitted in the accommodating portion, and a development sensor, the method comprising:

fitting a new replacement developing component;

configuring the operating member not to be in contact with the development sensor before the motor rotates the rotary member, rotating the motor to move the operating member on the rotary member to bring the operating member into contact with the development sensor;

making the development sensor output a first level when the development sensor is in contact with the operating member, making the development sensor output a second level when the development sensor is not in contact with the operating member; and receiving an output of the development sensor to judge, based on output levels of the development sensor at a first time point before the motor rotates and at a second time point after the motor rotates, whether the replacement developing component is fitted or not and whether a new replacement developing component is fitted or not.

* * * * *